United States Patent [19]

Kennedy

[11] 4,209,004

[45] Jun. 24, 1980

[54] TOY BASEBALL PITCHING MACHINE

[75] Inventor: Melvin Kennedy, Hampton Bays, N.Y.

[73] Assignee: Nagel/Kennedy & Associates, New York, N.Y.

[21] Appl. No.: 847,048

[22] Filed: Oct. 31, 1977

[51] Int. Cl.[2] ..... F41B 3/04

[52] U.S. Cl. ..... 124/7; 124/41 R; 124/16; 124/50

[58] Field of Search ..... 124/16, 17, 41 R, 32, 124/36, 7, 50; 221/17, 18

[56] References Cited

U.S. PATENT DOCUMENTS

| | | | |
|---|---|---|---|
| 1,799,106 | 3/1931 | Laxo | 221/14 |
| 2,877,757 | 3/1959 | Giovagnoli | 124/7 |
| 2,956,661 | 10/1960 | Radcliffe | 221/18 X |
| 3,511,225 | 5/1970 | Yokoi | 124/7 |

*Primary Examiner*—William R. Browne

*Attorney, Agent, or Firm*—Amster, Rothstein & Engelberg

[57] ABSTRACT

A toy baseball pitching machine that is particularly adapted to be used by children as an outdoor game. The toy baseball pitching machine of the present invention is capable of "pitching" a plastic ball approximately 15 feet to a "batter". The pitching machine is adjustable to pitch balls through varying trajectories. The present invention includes a ball storage rack for feeding a plurality of balls into the pitching machine seriatim and an automatic shut-off switch that shuts the pitching machine off when all balls are pitched.

6 Claims, 6 Drawing Figures

TOY BASEBALL PITCHING MACHINE

The present invention relates to toy baseball pitching machines for use in conjunction with plastic balls. The pitching machine is specifically adapted to throw the lightweight, plastic "baseballs" along paths of variable trajectory to enable a player to enjoy batting a succession of balls thrown towards him.

Prior art baseball pitching machines such as the machine disclosed in U.S. Pat. No. 2,877,757 to Giovagnoli are large, complex and necessarily quite expensive. Therefore, such apparatus would not be suitable for use as a toy. The pitching machine disclosed in U.S. Pat. No. 3,,511,225 to Yokoi, although small in size and simple, is not capable of throwing regulation size baseballs. Furthermore, the Yokoi machine contains rotating mechanism that is mounted externally and therefore, although designed for children, is not truly suitable for unsupervised use. Further, the pitching machine disclosed in U.S. Pat. No. 2,655,908 to Calleo is also not suited for use as a toy by children. This machine utilizes a conventional electric motor and, like the machine of Giovagnoli is not adaptable to battery operation. Both of these pitching machines are constructed to be plugged into conventional line current and will operate continuously without regard to whether there are additional balls to be thrown until the machines are manually turned off.

The present invention is related to a toy ball pitching machine that overcomes these and other shortcomings of the prior art and is particularly suitable for the use by children outdoors. Thus, it is a primary object of the present invention to provide a toy ball pitching machine that is suitable for outdoor use by children.

It is a further object of this invention to provide means whereby the toy ball pitching machine will automatically shut itself off to conserve battery power when all balls have been thrown.

It is a still further object of this invention to conserve electrical power by incorporating a drive mechansim that causes two throws for each full revolution of the drive means.

It is a still further object of the present invention to provide a toy ball pitching machine that has a completely enclosed drive mechanism that can be safely operated by children.

It is a still further object of the present invention to provide a machine that is capable of throwing full size plastic simulated baseballs.

It is a still further object of the present invention to provide a machine that is capable of storing a plurality of balls which are self-fed one at a time.

It is a still further object of the present invention to provide a machine having an adjustable trajectory, where the adjustment is effected by one readily accessible control.

It is a still further object of the present invention to provide a toy ball pitching machine that can be readily disassembled for storage, that is capable of being manufactured from molded plastic or other similar economical materials.

It is a still further object of the present invention to provide a toy ball pitching machine that is simple to operate.

In accordance with an illustrative embodiment demonstrating objects and features of the present invention, there is provided a ball pitching machine which includes a frame with a drive housing fixedly mounted thereon. There is an output drive means projecting from the drive housing which is operatively connected to motive means in the drive housing. A ball pitching arm is rotatably mounted to the drive housing about the ball pitching arm pivot and has a ball receiving recess at the end opposite the arm pivot end. A crank pivot arm is attached to the ball pitching arm at a location remote from the ball receiving recess and the arm pivot. The rotatable output drive means contains means for rotating the ball pitching arm relative to the motor housing to at least the top dead center position of the crank pivot arm relative to the arm pivot. At this point overrunning means in the output drive means allows an extension spring, connecting the frame to the crank pivot on the ball pitching arm, to urge the pitching arm past the top dead center position of the crank pivot causing the ball to be thrown by the machine along a preselected trajectory. The ball pitching arm is able to rotate rapidly past the top dead center position of the crank pivot by virtue of the overrunning means disengaging the ball pitching arm from the rotating means which brought the ball pitching arm to the top dead center position of the crank pivot. The frame of the pitching machine of the present invention is also provided with guard rails extending outwardly therefrom to allow the pitching arm to rotate within the guard rails.

The above description, as well as further objects, features and advantages of the present invention will be more fully understood by reference to the following detailed description of the presently preferred, but nonetheless illustrative embodiment in accordance with the present invention, when taken in conjunction with the accompanying drawings, wherein.

Figure 1:
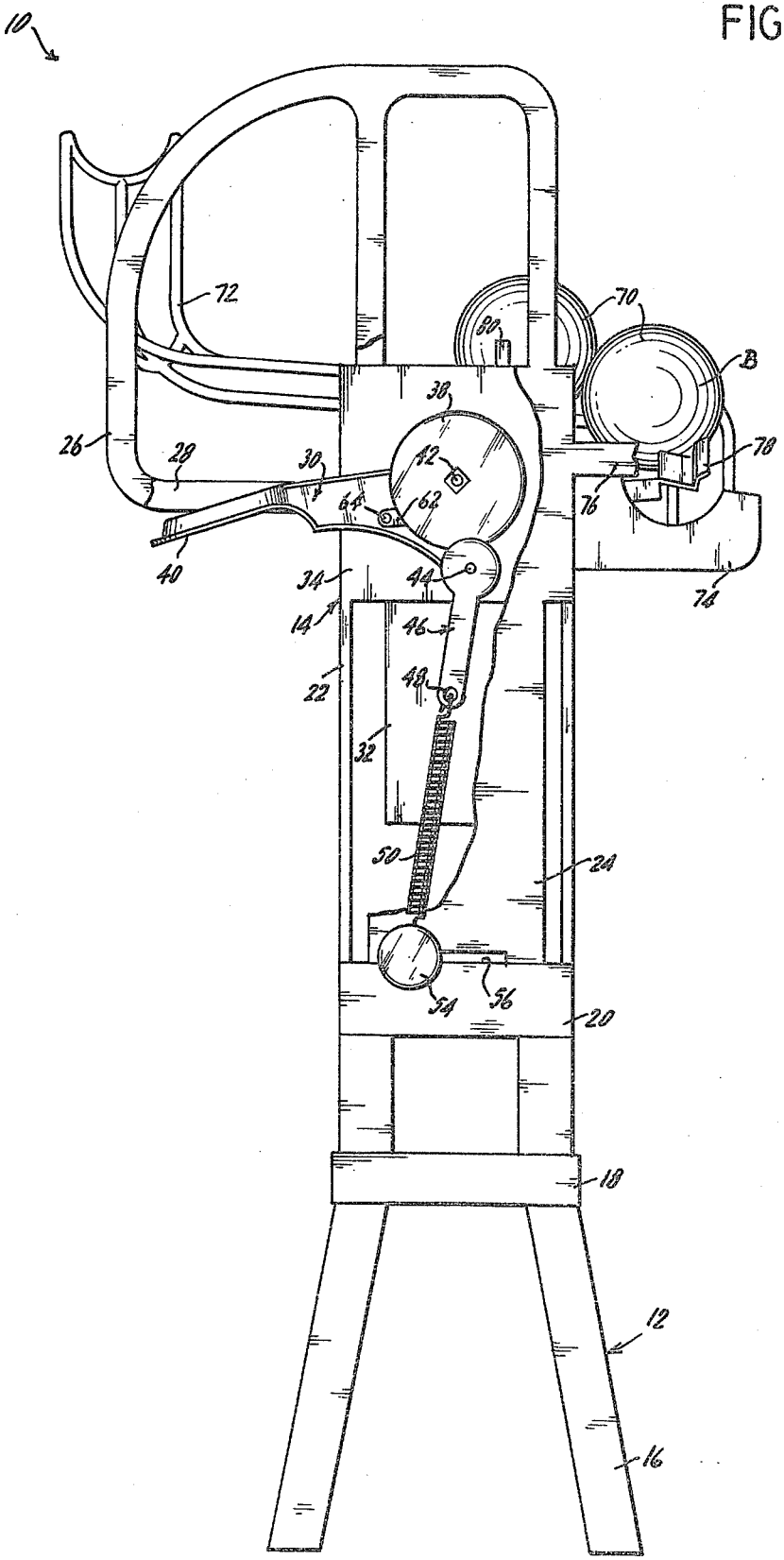
FIG. 1 is a side elevational view of the ball pitching machine of the present invention with parts of the frame broken away.

Referring now specifically to the drawings and in particular to FIG. 1, there is shown an illustrative ball pitching machine embodying objects and features of the present invention generally designated by the reference numeral 10, which includes a four-legged frame base portion 12 and a frame main portion 14.

The frame base portion 12 is comprised of four substantially identical legs 16 and a leg retainer 18 adapted to maintain the legs in rigid relationship relative to each other. Each leg 16 is slidably engageable within the bottom section 20 of frame main portion 14.

The frame main portion 14 is comprised of a substantially rectangular motor frame 22 and a corresponding front frame 24 (shown broken away). The upper portion of the main frame portion contains integral, upwardly extending front and rear guard frames 26, 28, respectively. Each portion of the frame and base are formed from molded plastic or like material and is readily disassembleable for storage.

Figure 3:
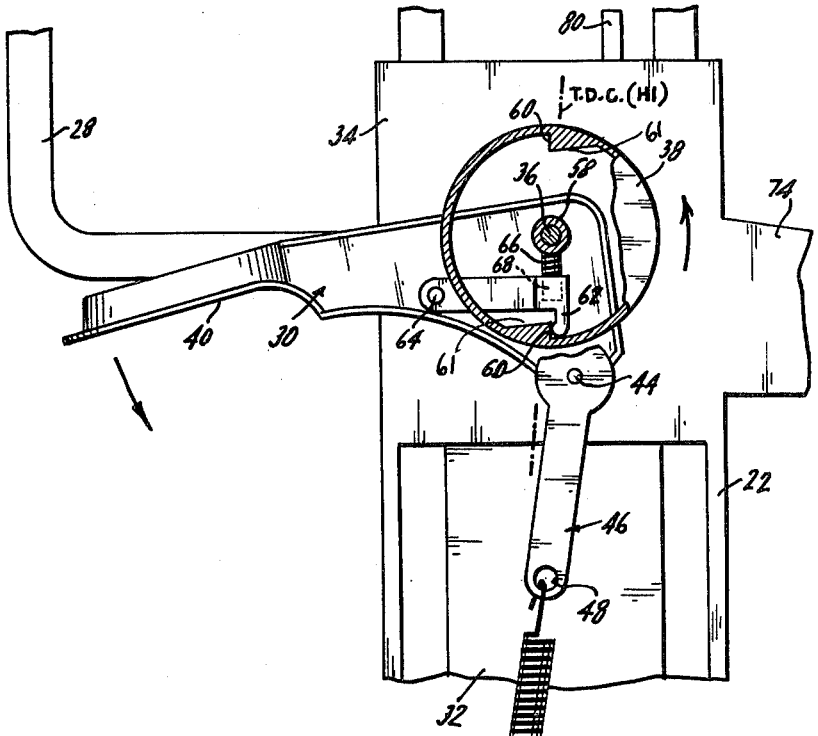
FIG. 3 is a fragmentary, side elevational view of the ball pitching machine showing the ball pitching arm rotated to the position it would assume after a ball has been pitched.
Figure 2:
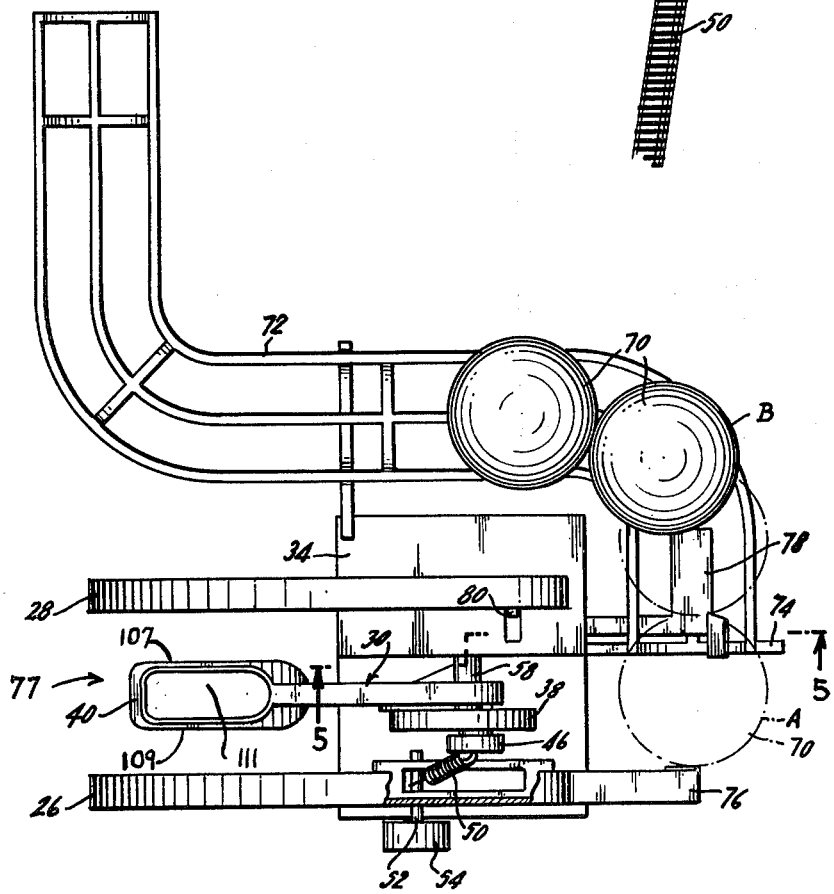
FIG. 2 is a top plan view of the ball pitching machine with a portion of the frame broken away.

As best shown in FIG. 2, rotating ball pitching arm 30 is located between the front and rear guard frame 26, 28. Rotating ball pitching arm 30 has a ball receiving portion 40 at a first end and a pivot point 42 at the second end. As shown in FIG. 3, the ball pitching arm 30 further includes a crank pivot point 44 remote from said pivot point 42 along a line substantially perpendicular to a line between pivot point 42 and the extremity of the ball receiving end of said ball pitching arm 30.

Battery box 32 is integral with motor frame 22 and is directly below drive housing 34 which is located in the top portion of motor frame 22. As described below, drive housing 34 contains an electric motor 106 (FIG. 5) driving an output shaft 36 projecting therefrom. Ratchet wheel 38 is journaled to output shaft 36. Specifically, the output shaft 36 is rotated by the electric motor transmitting rotational force through a gear train including a plurality of gears (not shown) and ultimately driving output gear 39 journaled to output shaft 36 at the end remote from ratchet wheel 38.

Crank link 46 is rotatably mounted to the rotating ball pitching arm 30 at crank pivot 44 and the second end of crank length 46 contains an aperture 48 through which a hook formed on the first end of power spring 50 is connected. A hook formed on the second end of power spring 50 is connected to shaft and knob assembly 52, 54. The shaft and knob assembly 52, 54 is slidably engaged within adjusting slot 56 formed in the bottommost portion of front frame 24 to allow lateral movement of shaft 52 relative to crank pivot point 44.

Pivot bushing 58 is integrally formed on the rotating ball pitching arm 30 in the area of the arm pivot point 42 to increase the bearing surface of rotating ball pitching arm 30 on output shaft 36.

As shown in FIG. 3, ratchet wheel 38 (shown partly in section) which is journaled to output shaft 36 and caused to rotate thereby, contains two ratchet teeth. The rotation of ratchet wheel 38 is translated to rotating ball pitching arm 30 by pawl 62 rotatably connected to ball pitching arm 30 by pawl pivot pin 64. Pawl 62 is maintained in sliding engagement with the inner substantially cylindrical surface of ratchet wheel 38 by the restoring force of pawl compression spring 66. Pawl compression spring 66 is received within recess 68 in pawl 62 causing pawl 62 to be urged away from pivot bushing 58. As shown in FIG. 3, when ratchet wheel 38 is caused to rotate in a counterclockwise direction (indicated by the arrow) the engagement of pawl 62 in ratchet tooth 60 translates the rotation of ratchet wheel 38 to rotating ball pitching arm 30.

Figure 4:
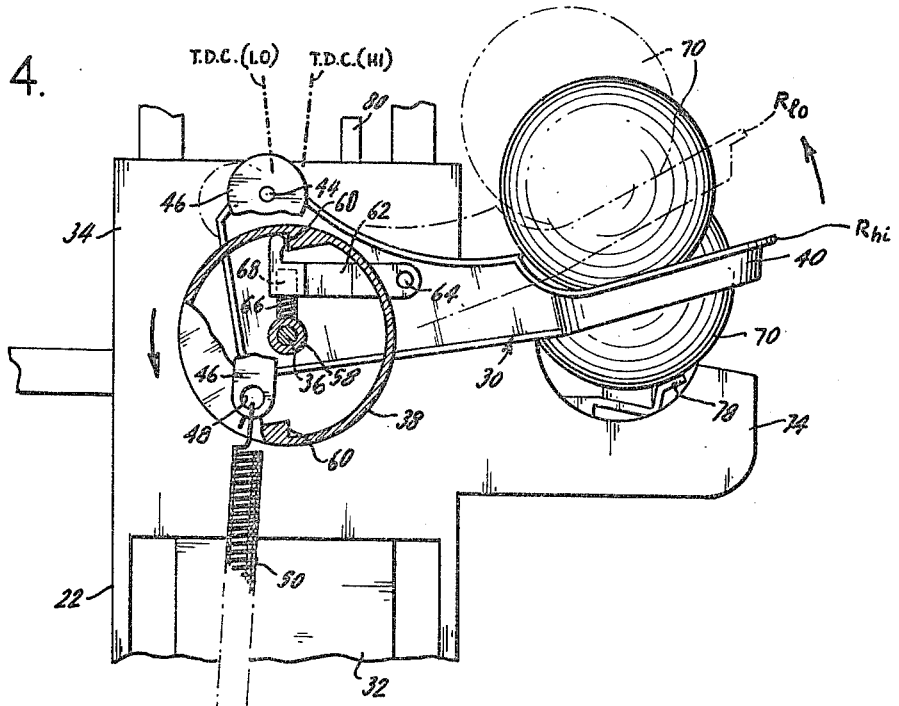
FIG. 4 is another fragmentary, side elevational view showing the pitching arm at the moment of release of the pitching arm relative to the output drive means for a high "pitch". The phantom lines show the position of the pitching arm at the moment of release for a low "pitch"
Figure 4:
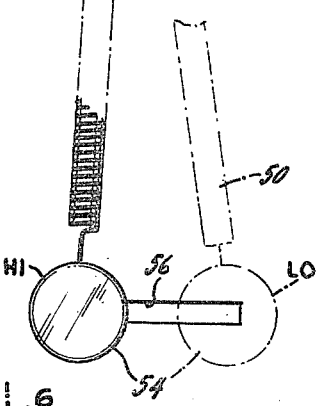

As ratchet wheel 38 and rotating ball pitching arm 30 are caused to rotate from the position shown in FIG. 3 to FIG. 4, crank 46 is caused to move upwardly extending power spring 50. From the position of rotating ball pitching arm 30 shown in FIG. 3 to the position shown in FIG. 4, pitching arm 30 is caused to rotate by the rotation of output shaft 36 and ratchet wheel 38 journaled thereto which drag ball pitching arm 30 as a result of the engagement of pawl 62 against the flat face of ratchet tooth 60. However, when rotating ball pitching arm 30 reaches the position shown by the solid lines in FIG. 4 power spring 50 urges crank length 46 downwardly causing rotating ball pitching arm 30 to overrun ratchet wheel 38 resulting in the sudden rapid rotation of ball pitching arm 30 in the counterclockwise direction shown by the arrow.

The point in the rotation of ball pitching arm 30 at which the force of power spring 50 causes rotating ball pitching arm 30 to overrun ratchet wheel 38 is adjustable between the position shown by the solid lines in FIG. 4 which would result in a high pitch and the position shown by the phantom lines in FIG. 4 which would result in a low pitch. The top dead center position (T.D.C.) for both high and low pitches is indicated in FIG. 4. Top dead center is defined as that position when the crank pivot point 44, the arm pivot point 42 and the axis of shaft 52 are all collateral. As soon as the ball pitching arm 30 and crank length 46 pass the top dead center position the action of power spring 50 will cause the pitching arm 30 to rotate rapidly. The point of release for a high pitch is designated $R_{hi}$ and is shown by the solid lines in FIG. 4. By moving control knob 54 from the position shown by the solid lines in FIG. 4 to the position shown by phantom lines therein requires ball pitching arm 30 to rotate approximately 20° further to the low release position designated $R_{Lo}$. Because of friction between the pieces pivoting at the various pivot points, release does not occur until the pitching arm rotates several degrees past the top dead center point. However, as the internal friction remains substantially constant from pitch to pitch, as long as knob 54 is kept in the same position in adjusting slot 56 the trajectory of the pitched ball 70 will remain substantially constant from pitch to pitch.

As the present invention is suited for outdoor use, the electrical power comes from batteries 72 contained in battery box 32. In order to conserve battery power, several novel features are incorporated in the present invention. For example, ratchet wheel 38 is provided with two ratchet teeth 60, disposed substantially 180° apart along the inner cylindrical surface of ratchet wheel 38. This spacing allows the first ratchet tooth 60 to rotate ball pitching arm 30 from the position shown in FIG. 3 to the position shown in FIG. 4. As soon as pitching arm 30 reaches release position $R_{hi}$, power spring 50 drives ball pitching arm 30 rapidly through approximately 180°, overrunning ratchet wheel 38, to the orientation shown in FIG. 3. Just prior to ball pitching arm 30 assuming the orientation shown in FIG. 3, pawl 62 is caused to compress pawl compression spring 66, riding over the crest 61 of ratchet tooth 60, coming to rest against the flat wall of ratchet 60. In this manner, rotating ball pitching arm 30 is caused to rotate two times for each revolution of ratchet wheel 38.

As more fully described below, the ball pitching apparatus of the present invention includes an automatic shutoff switch which automatically deenergizes the electric motor 106 (shown dotted in FIG. 5) in drive housing 34. FIG. 2, best shows a ball track assembly 72 removably fastened to the rear wall of motor frame 22. The ball track assembly is constructed and arranged to store approximately six balls to permit the balls to enter into space between track receiving extension 74 of motor frame 22 and ball stop projection 76 on front frame 24 seriatim. The area between track receiving extension 74 and ball stop projection 76 defines ball pick-up area 77 and keeps ball 70 (designated by the reference letter A in FIG. 2) in ball pick-up area 77 in proper orientation so the plane of rotation of rotating ball pitching arm 30 is substantially coexistent with the center of ball A allowing ball A to fit within ball receiving portion 40 of pitching arm 30 as the arm rotates towards the position shown by the solid lines in FIG. 4.

Figure 6:
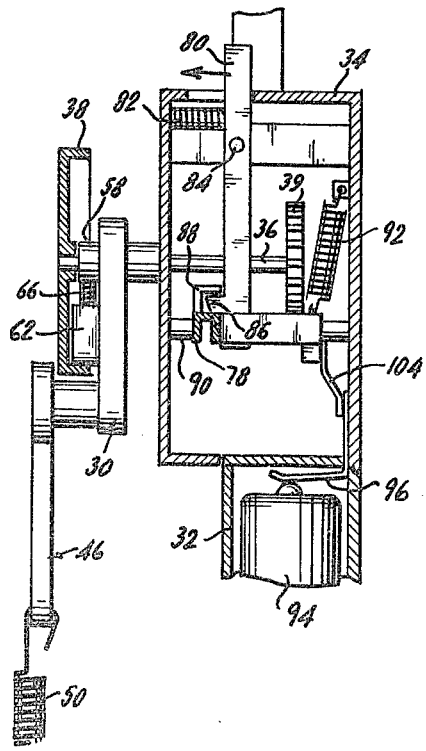

As discussed above, the ball pitching apparatus of the present invention incorporates an automatic shutoff switch to conserve battery power. The switch will cause the deenergization of the electric motor 106 in the drive housing 34 when none of the balls 70 remain in ball track assembly 72. The automatic shutoff switch operates substantially in the following manner: As balls 70 advance towards track receiving extension 74 by the force of gravity, the first ball (shown by the solid lines in FIG. 2 and given the reference designation B) comes into engagement with automatic shutoff arm 78 preventing ball B from resting in ball pick-up area 77. To activate the ball pitching apparatus, "on" switch rocker arm 80 is rotated counterclockwise as shown in FIG. 6 against "on" switch compression spring 82 about "on" switch pivot 84 causing "on" switch pawl 86 to disengage member 88 on shut-off arm 78. Once member 88 is disengaged, the weight of ball B causes shutoff arm 78 to rotate downwardly in a clockwise direction (shown in FIG. 5) about shut-off arm pivot 90 extending shut-off arm recess spring 92 to activate the electric motor.

Figure 5:
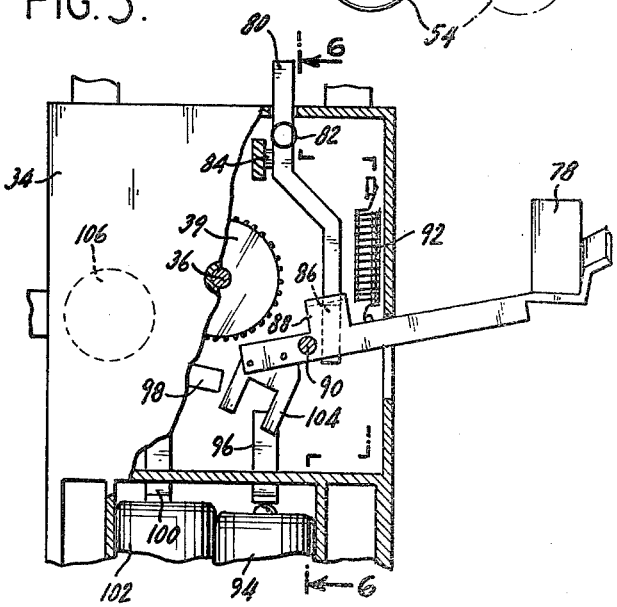
FIG. 5 is a sectional view taken substantially along the line 5—5 in FIG. 2 illustrating several of the components within the drive housing; and, FIG. 6 is a sectional view, taken substantially along the line 6—6 in FIG. 5 illustrating a portion of the internal components of the drive housing.

As seen in the lower portion of FIGS. 5 and 6, battery 94 makes electrical contact with the first contact 96. A second contact 98 is connected to the first lead of an electric motor 106. Third contact 100 is in electrical engagement with battery 102. The electrical circuit to the motor is completed when automatic shut-off arm 78 is rotated from the position shown in FIG. 5 downwardly causing moveable contact 104 mounted to the end of shut-off arm remote from the ball engaging portion of the automatic shut-off arms 78 to make sliding contact with both the first contact 96 and the second contact 98.

Shut-off arm reset spring 92 is proportioned so that the weight of ball 70 is sufficient to maintain automatic shut-off arm 78 in the motor activating position (not shown in FIG. 5). After the last ball is pitched the restoring force of shut-off arm reset spring 92 causes automatic shut-off arm 78 to rotate counterclockwise, back to the position shown in FIG. 5 thereby interrupting the electrical path between first contact 96 and second contact 98 thereby deenergizing the motor.

To allow the ball pitching apparatus of the present invention to be safely utilized by children without close supervision, the entire drive means for said ball pitching arm is fully enclosed. The pawl 62 is entirely within ratchet wheel 38 engaging ratchet teeth 60 therein. Similarly, the rotation of ball pitching arm 30 is substantially, entirely between front guard frame 26 and rear guard frame 28. Likewise, power spring 50 resides within the protective confines of front frame 24 minimizing the likelihood of injury if the spring or attaching points should break.

Another feature contributing to the particular utility of the present apparatus is the shape of the ball receiving portion 40 of ball pitching arm 30. Specifically ball receiving portion 40 contains spaced parallel side rails 107, 109 (FIG. 2) which define an aperture 111. Side rails 107, 109 are spaced from each other to provide a means for lifting and throwing ball 70, however, aperture 111 assures that smaller objects, such as rocks and stones cannot be thrown by the ball pitching apparatus.

Although the invention herein has been described with reference to a particular embodiment, it is to be understood that this embodiment is merely illustrative of the principles in application of the invention. Thus, it is to be understood that numerous modifications may be made in the illustrative embodiment and other arrangements may be devised without departing from the spirit and scope of the invention.

What is claimed:

1. A ball pitching machine comprising:

(a) a frame;

(b) a drive housing fixedly mounted on said frame;

(c) a rotatable output drive means projecting from said drive housing for rotating a pitching arm;

(d) motive means in said drive housing operatively connected to for operating said drive means;

(e) a ball pitching arm including a ball receiving recess at a first end of said ball pitching arm and a crank pivot remote from said ball receiving recess;

(f) means rotatably mounting said ball pitching arm to said drive housing including a ball pitching arm pivot in said arm at a location remote from said ball receiving recess and said crank pivot;

(g) said rotatable output drive means including means contained wholly within said output drive means for rotating said ball pitching arm relative to said drive housing to at least a top dead center position of said crank pivot relative to said ball pitching arm pivot comprising a hollow cylindrical drive wheel having at least two ratchet teeth projecting radially inwardly from a substantially cylindrical inner surface of said hollow cylindrical wheel and a pawl moveably mounted to said ball pitching arm in engaging relationship with one of said at least two ratchet teeth, said pawl translating rotation of said rotatable drive means to said ball pitching arm and a means for said ball pitching arm overrunning said rotating means;

(h) an extension spring connecting said frame to said crank pivot on said ball pitching arm constructed and arranged to rapidly urge said ball pitching arm past said top dead center position of said crank pivot activating said overrunning means;

(i) guard rails extending outwardly from said frame a sufficient radial distance from said ball pitching arm pivot to allow said ball pitching arm to rotate past top dead center substantially within said guard rails.

2. The ball pitching machine as recited in claim 1 wherein said overrunning means comprises a substantially flattened portion of said inner cylindrical surface, resilient means urging said pawl against said inner surface and an inclined surface on each of said at least two ratchet teeth constructed and arranged for said pawl to move out of engaging relationship with one of said at least two ratchet teeth when said ball pitching arm is rotated past said top dead center position causing said pawl to advance along said inclined surface and into engaging relationship with an other of said at least two ratchet teeth as said extension spring urges said ball pitching arm to rotate.

3. The ball pitching machine as recited in claim 1 wherein said motive means in said drive housing comprises an electric motor mounted to said drive housing and having an output gear, a plurality of gears mounted within said drive housing in operative relationship to said output gear on said electric motor, and a shaft output gear driven by said plurality of gears and journaled to an output shaft projecting from said drive housing whereby activation of said electric motor causes rotation of said output shaft.

4. The ball pitching machine recited in claim 3 wherein said motive means further includes at least one battery and an interruptable connection from said battery to said electric motor, said interruptable connection comprises first and a second contacts mounted in said drive housing, a switch arm and a moveable contact mounted on said switch arm, said switch arm is pivotably mounted to said drive housing and adapted to pivot from a first position wherein said moveable contact does not engage said first and second contacts to a second position wherein said moveable contact is in engagement with said first and second contacts thereby completing said connection from said battery to said electric motor.

5. The ball pitching machine as recited in claim 1 further including means for adjusting said top dead center position of said crank pivot relative to said ball pitching arm pivot.

6. The ball pitching machine as recited in claim 5 wherein said means for adjusting said top dead center position comprises a shaft mounted on said frame moveable horizontally relative to said ball pitching arm pivot and means for connecting said shaft to said extension spring.

* * * * *